US005692059A

United States Patent [19]

Kruger

[11] Patent Number: 5,692,059

[45] Date of Patent: Nov. 25, 1997

[54] TWO ACTIVE ELEMENT IN-THE-EAR MICROPHONE SYSTEM

[76] Inventor: Frederick M. Kruger, 37 Somerset Dr., Comack, N.Y. 11725-1636

[21] Appl. No.: 393,839

[22] Filed: Feb. 24, 1995

[51] Int. Cl.[6] ..... H04R 25/00

[52] U.S. Cl. ..... 381/151; 381/68.3; 381/68.6

[58] Field of Search ..... 381/68, 68.2, 68.3, 381/68.4, 68.6, 151, 23.1, 183, 68.5, 91, 95, 122, 169

[56] References Cited

U.S. PATENT DOCUMENTS

| | | | |
|---|---|---|---|
| 3,258,533 | 6/1966 | Bredon | 179/1 |
| 4,442,323 | 4/1984 | Yoshida et al. | 381/95 |
| 4,548,082 | 10/1985 | Engebretson et al. | 381/68.2 |
| 4,833,719 | 5/1989 | Carme et al. | 381/72 |
| 4,972,491 | 11/1990 | Wilcox, Jr. | 381/187 |
| 5,125,032 | 6/1992 | Meister et al. | 381/183 |
| 5,208,867 | 5/1993 | Stites, III | 381/169 |
| 5,280,524 | 1/1994 | Norris | 379/387 |
| 5,295,193. | 3/1994 | Ono | 381/68 |
| 5,298,692 | 3/1994 | Ikeda et al. | 181/135 |

OTHER PUBLICATIONS

Radio Shack Realistic® Owner's Manual for Model 504 transceiver (#21–404) with in–the–ear microphone/earphone, p. 2. Tandy Corporation, Fort Worth, TX 76102.

Telex® User's Instructions for EM–150 Ear–Mike® In–the–ear earphone/microphone, Sep., 1991, 4 pages. Telex Communications, Inc. 9600 Aldrich Ave. So., Minneapolis, MN 55420.

Temco Voice–Ducer® EM In–the–ear earphone/microphone Operating Instructions, pp. 1,2,9. Temco Communications, INc. 13 Chipping Campden Drive, South Barrington, IL 60010.

Comply™ Foam Canal Tip General Instructions, Hearing Components, Inc., 2000 Crestview Drive, Maplewood, MN 55119, 2 pages.

Eartalk Invisible Mic Bubble–Pak card show "R.O.C. PAT NO 66490, Pat Pend:P.R.O.C., Japan, U.S.A., Germany".

*Primary Examiner*—Curtis Kuntz
*Assistant Examiner*—Rexford Barnie
*Attorney, Agent, or Firm*—Greer, Burn & Crain, Ltd.

[57] ABSTRACT

The herein described invention relates to an ear mounted, in-the-ear compound microphone system which simultaneously uses both an accelerometer, or vibration transducer, to sense bone conducted low speech frequencies and a microphone with controlled frequency response to sense airborne high speech frequencies within the ear canal. It combines the speech spectrum components picked up by the two transducers into a single composite audio signal with improved human speech frequency response characteristics. It simultaneously demonstrates significantly reduced sensitivity to surrounding background noise and provides measurable hearing protection for the user. Through adjustment and alteration of the supporting electronic circuitry, the operating characteristics and performance of the compound microphone can be changed. The in-the-ear microphone system can be used with a two-way speech system by installing a miniature earphone element within a common housing with the microphone.

14 Claims, 3 Drawing Sheets

TWO ACTIVE ELEMENT IN-THE-EAR MICROPHONE SYSTEM

BACKGROUND

1. Field of Invention

This invention relates to microphones, specifically to a microphone system that picks up a wearer's bone, soft tissue, and air-space conducted speech using a noise discriminating, two active element in-the-ear microphone system.

2. Description of Prior Art

The need for voice activated and controlled systems is not new. It has been long recognized that adequate techniques for speech control are needed for computer systems, cellular and hands-free telephones, airborne and mobile communication systems, emergency medical communication systems, special assistive and communication aids and control systems for persons with various disabilities, and other voice input systems. At present, most systems require some manual intervention because of inadequate speech recognition. This is due, in pad, to poor speech detection and/or interfering noise picked up by presently available (hand-held, boom-mounted, and other style) microphones.

Many voice communication systems and virtually all speech recognition systems require the conversion of speech audio input to a digital format. If the incoming speech spectrum has incorrect amplitude vs. frequency characteristics, the dynamic range of the system may be limited and lower energy high frequency speech sounds may not be converted correctly. Ambient noise picked up by the microphone acts to reduce speech intelligibility and, thereby, reduces the probability of correct conversion to digital form for speech activated systems. Typically, this noise has most energy in the low voice frequency range.

The higher frequency speech sounds, such as those from consonants and particularly fricatives as, for example; s, sh, t, th,f, have significantly lower energy than low frequency speech sounds; such as: ah, oo, eh, ee. For an average talker, this difference is at least 10 decibels. In addition to having more energy, the lower frequency speech sounds are better conducted via the bone and tissue paths of the head and neck. This leads to an even greater emphasis of the lower speech frequencies when sensed solely by an accelerometer, or vibration sensor. Thus, the sounds picked up only by a bone conduction transducer are a mix of low frequency speech sounds and a small amount of ambient background noise. The higher frequency speech sounds either are severely attenuated or absent. With emphasized low frequencies, speech intelligibility, word recognition, and system response accuracy to the audio signals are reduced. To regain some of the higher speech frequency sounds, increased pressure is required between the bone conduction transducer and the bone structure(s) of the head. This increases user discomfort. The result can be poor acceptance of the device and preference for more conventional, although less desired or convenient, microphone and headset options.

When the in-the-ear microphone design is based upon a more conventional "airborne sound sensing" transducer in the ear canal, low frequency sounds are again emphasized. Further, since most ambient background noise occurs at relatively low frequencies, this noise can couple directly to the sensing element and cause further deterioration of the speech sounds.

The patent of Bredon, U.S. Pat. No. 3,258,533, discloses an in-the-ear, custom molded microphone system containing a microphone designed to pickup sounds within the ear canal. One dynamic microphone element is used to sense the sounds. A preamplifier with 20 dB of gain, plus a 9 dB per octave boost above 1 kHz, to 10 kHz, is used to amplify the weaker high frequency sounds and correct for transducer characteristics. The result of such a design is that all high frequency sounds, including device and circuit noises and higher frequency ambient noises, are amplified indiscriminately. The custom molded housing requires an exact fit within the concha bowl and outer ear canal during movement and speech, to provide any useful ambient noise blockage. Also, the low frequency ambient background noise will be sensed by the described microphone and will act to interfere with and mask higher frequency components of detected speech. Thus, the described device can pick up low frequency noise and amplifies high frequency noises beyond the desired speech frequencies.

The patent to Ono, U.S. Pat. No. 5,295,193, discloses a device for picking up bone-conducted sound by pressing a bone-conduction microphone against an ear canal wall. Although this device is capable of picking up bone-conducted speech sounds, it is insensitive to high frequency speech sounds present within the air contained in the ear canal. It discriminates against the higher frequency speech sounds. This discrimination is due to the known decrease in sensitivity of bone-conduction microphones to the airborne higher speech frequencies. While the detected signal to ambient noise ratio (S/N) can be high, the reduced frequency response can cause diminished intelligibility. Also, there is a reduction in the probability of accurate electronic speech recognition. This devices discriminates against airborne sound by design.

The patent to Wilcox, Jr., U.S. Pat. No. 4,972,491, relates to voice communication in a very high noise environment. It discloses a combination hearing protector and communications headset with a spring loaded headband clamping a rigid circumaural earcup over each ear. Further disclosed in each foam-filled earcup are spring-loaded single flange "earplug-type transducers that function as a combination ultrasensitive microphone and speaker". Although this device may be suitable for voice communications in extremely high noise environments, its weight and the fact that the user virtually has his/her head clamped in a two-tiered spring-loaded vise precludes its use in many commercial, industrial, or residential environments, or by many physically disabled persons.

The patent to Norris, U.S. Pat. No. 5,280,524, describes an ear-mounted bone-conduction sensing device that contacts the individual's skull outside the ear canal. Although this device does pick up speech sounds through head conducted bone vibrations, It discriminates against airborne speech within the ear canal. Further, it offers little to no hearing protection.

The patent to Stites, III, U.S. Pat. No. 5,208,867, discloses an earplug based microphone assembly designed to provide isolation from environmental sounds. The device's sound sensing element is placed at the distal end of a sound tube that penetrates the earplug with its proximal end. The device is designed to pick up speech sounds from the air in the ear canal. No attempt is made to obtain speech sounds from the surrounding bone structures.

The patent to Meister et al, U.S. Pat. No. 5,125,032, discloses a talk/listen headset that uses a protective earcup containing a two identical, parallel connected bone-conduction microphone elements. Neither microphone element is placed within the external ear, or the ear canal. Both are pressed against bones of the face. There is no indication that the microphone outputs can be combined in any controlled manner. An earphone is contained within the earcup. This speech pickup system is designed to discriminate against all airborne sounds.

The patent to Ikeda et al., U.S. Pat. No. 5,298,692 discloses an earpiece and earphone, microphone and earphone/microphone combinations including the earpiece. In one embodiment, the earpiece contains a bone-conduction vibration pickup to convert the wearer's voice sounds into an electrical signal. In another embodiment, the earpiece contains both a bone-conduction pick-up and an earphone element, or receiver. Pickup of high frequency voice sounds is not addressed, nor is the question of speech intelligibility in various ambient noise conditions. This device is designed to discriminate against airborne speech sounds. Each embodiment contains only one transducer to sense the wearer's speech.

The patent to Carme et al., U.S. Pat. No. 4,833,719, references the use of a single airborne sound pickup microphone element placed at the entrance to the ear canal. The microphone is used as an error sensing and feedback component of an active noise cancellation system. It is used to pick up ambient noise within the containing circumaural earcup; not the wearer's voice.

In-the-ear bone-conduction transducers are limited in high speech frequency sensing unless pressed hard against the ear canal wall. Dynamic element microphones have very low sensitivity, poor frequency response, and respond to ambient noise. What is needed is a microphone system that optimizes the pickup of all available speech frequency sounds in the ear canal and provides a high quality, wide-band speech signal. This is essential in order to provide a highly intelligible speech signal to speech recognition systems and communication systems.

OBJECTS AND ADVANTAGES

Accordingly, it is one object and advantage of the present invention to eliminate the above disadvantages and to provide an improved in-the-ear microphone system. This new system simultaneously uses both a bone and tissue vibration sensing transducer to respond to conducted lower speech frequency voice sounds and a band-limited acoustical microphone to detect the weaker airborne higher speech frequency sounds in the ear canal. In combination, these two transducers sense a wider band of voice frequencies, with a balanced response, for better speech intelligibility. Another object and advantage is to use an electret microphone, which is designed with its sensitivity limited to the higher voice frequencies, to pickup lower amplitude high frequency voice sounds transmitted to the air within the ear canal; thereby reducing the need for very high gain amplifiers and sharp cut-off filters to provide similar characteristics. Another object and advantage of the invention is to use an accelerometer, or vibration sensing transducer, to sense the higher amplitude low voice frequencies, while discriminating against ambient background noise. Still another object and advantage is the use of an electronic circuit to combine the high and low frequency signals and facilitate independent adjustment of low frequency and high frequency characteristics. Further objects and advantages of this invention are: to provide a two active element in-the-ear microphone system that is easy to use, to require less pressure against ear and head structures, to provide reduced sensitivity to ambient background noise, to provide the user with a measurable level of hearing protection, to optionally contain a wide frequency range earphone element with canal resonance compensation, and to provide a microphone system which is easily manufactured as a semi-custom or fully custom fit in-the-ear system. Yet another object and advantage of this invention is to provide a means by which a user can customize the fit through use of a removable ear canal tip.

In the preferred embodiment of the two active element in-the-ear microphone, two different transducers elements are used in novel combination to optimize the in-the-ear detection and transduction of a user's speech frequency energy. Bone and tissue conducted low speech frequency range sound energy is received by a vibration sensor. High speech frequency range sounds in the air within the ear canal are simultaneously sensed by a miniature electret microphone element, which is manufactured to provide significant emphasis of the higher speech frequencies. The electrical signals from each of these transducers are combined electronically to provide a single full spectrum audio signal. The use of two separate sound receiving transducers, each optimized for the frequency range over which it operates, reduces the requirement for technically complex electronic circuits. Moreover, the use of the limited bandwidth microphone reduces the pickup of extraneous noises present in the ear canal.

Still further objects and advantages will become apparent from a consideration of the ensuing description and accompanying drawings.

SUMMARY

A new in-the-ear combination bone-conduction and air-conduction dual element microphone and microphone/earphone system for use with external systems requiring speech sound input and/or bi-directional speech communication and comprising a housing with a short extension tube about which is affixed a removable compliant ear canal tip. The housing contains a vibration sensing bone-conduction pickup, a miniature electret microphone with sensitivity only to airborne high speech frequencies and, optionally, a miniature magnetic or electro-dynamic receiver.

PREFERRED EMBODIMENT—DESCRIPTION

Other objects and features of the present invention will become apparent from the following detailed description considered in connection with the accompanying drawings.

The drawings disclose several embodiments of the present invention. It should be understood, however, that the drawings are designed for the purpose of illustration only and not as a definition of the limits of the invention.

Figure 1A:
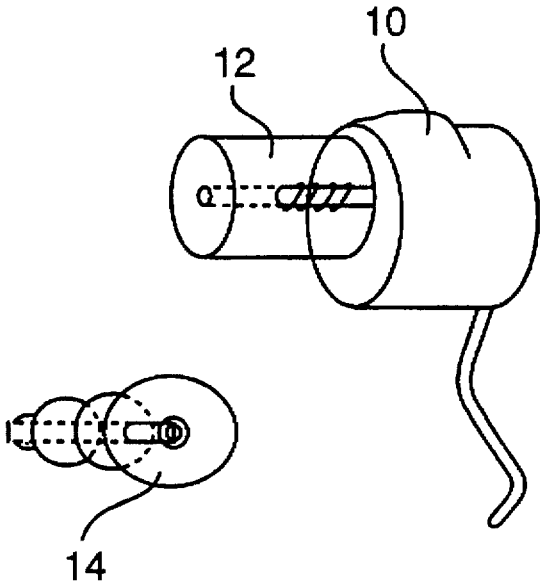
FIG. 1A shows a perspective view of an in-the-ear two element microphone system formed in accordance with my invention.
Figure 1B:
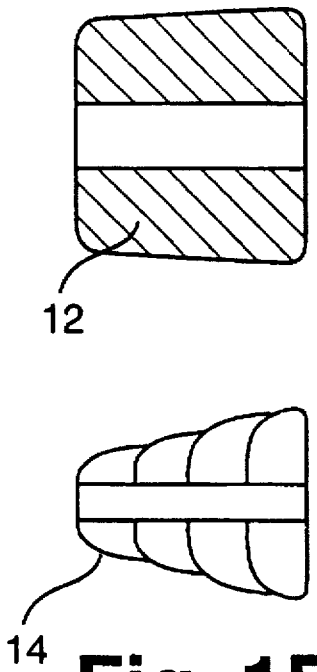
FIG. 1B shows cross-section elevation views of two alternative types of removable pliable ear canal tips.

A typical embodiment of the two element in-the-ear microphone of the present invention, as shown in FIG. 1A (perspective view), may comprise a miniaturized shell, case, or housing 10 in the form of an earplug, which may have the shape shown, or any other suitable shape, with an ear canal tip 12 designed to be supported by the external auditory meatus, or ear canal not shown) and the immediately adjacent bowl, or concha portion of the external ear (not shown). FIG. 1A also shows an alternative compliant silicone flanged ear canal tip 14. Housing 10 may be formed of plastic, silicone, metal, or other suitable material. FIG. 1B shows typical elevation sections of a ear canal tip 12 and a silicone multiple flanged ear canal tip 14.

Figure 2:
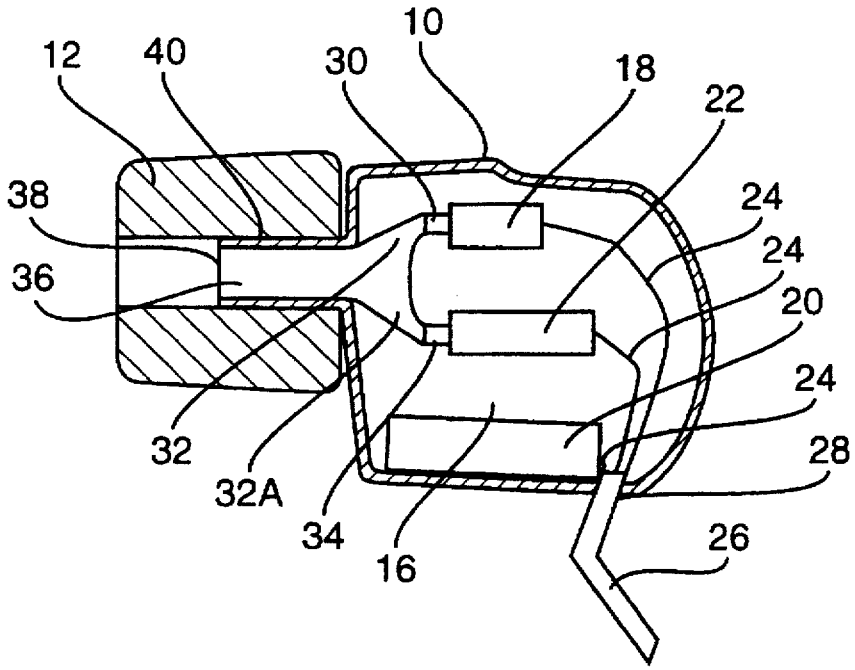
FIG. 2 shows a cross-section elevation view of a two element in-the-ear microphone system, with an internal receiver element, formed in accordance with the present invention.

In accordance with the invention, FIG. 2 shows a cross-section elevation view of the housing 10, which is formed with a hollow interior 16, that may be filled with sound dampening foam, low density silicone, or other sound dampening materials. An airborne sound sensing transducer, or microphone element 18, an accelerometer, or vibration-sensing element 20, and an optional speaker, earphone, or receiver element 22, are mounted within the housing 10. Ear canal tip 12 may be of a compliant, or visco-elastic foam construction, as represented by the COMPLY brand soft ear canal tips of Hearing Components Inc., Maplewood, Minn. Microphone element 18 and vibration-sensing element 20 have electrical and signal leads 24, which converge with electrical and signal leads 24 from the receiver element 22, into cable 26. The electrical and signal leads 24 from the distal end of cable 26 are connected to associated electronic circuitry and power source (not shown), which may be remote from housing 10, or contained therein. The cable 26 passes through a strain-relief or bushing 28, of common design, as it exits the housing 10.

High Frequency Microphone

Microphone element 18 may preferably be an electret microphone, having a frequency response that emphasizes the higher speech frequencies, in a range of approximately 2 to 6 kilohertz. Representative high-frequency emphasizing microphone elements that may be used in this application are available from Knowles Electronics, Inc., Itasca, Ill., as their model EK-3029 or EK-3031. Microphone element 18 is fitted with a short hollow tip, or sound receiving port 30, to which sound tube 32 is coupled.

Vibration Transducer

Vibration-sensing element 20 is preferably a miniature accelerometer, or vibration sensor, such as Knowles model BU-1771. This vibration-sensing element 20 senses sounds and vibrations directly through its housing. Therefore, it is mounted firmly to the housing 10, which then serves as a sound and vibration conducting element. Vibration-sensing element 20 may be adhered to the housing 10 by an appropriate cement or glue, or by a friction fit, as known to those versed in the art.

Receiver

Receiver element 22, which is preferably of a balanced armature type magnetic design as known in the art. A representative receiver element 22 with the appropriate characteristics is the Knowles model EP-3075. It is fitted with a short hollow tip, or sound transmitting port 34, to which sound tube 32A is coupled. Sound tubes 32 and 32A merge into a single bi-directional manifold, chamber, or sound mixing tube 36, distal to the sound port couplings at sound receiving port 30 and sound transmitting port 34. The distal end of sound mixing tube 36 extends into hollow extension tip 38, which extends through and provides support for ear canal tip 12, or other appropriate ear canal tip, as known in the art. Hollow extension tip 38 thus couples sound from an ear canal (not shown) to microphone element 18 and sound from receiver element 22 to the ear canal.

Ear Canal Tip

Ear canal tip 12, which serves as a primary interface between housing 10 and ear and head structures (not shown), is securely mounted on hollow extension tip 38 of housing 10, which surrounds the distal end of sound mixing tube 36. It couples voice-generated sound vibrations from bone, soft tissue, and air space structures in a wearer's head and neck to the sound sensing elements, microphone element 18 and vibration-sensing element 20. The exterior surface of hollow extension tip 38 may be provided with retaining ridges, or a coarse thread 40. Since ear canal tip 12 is formed of a compressible material, such as a foamed material, the mating portion of ear canal tip 12 may be, but need not be, provided with a core having a mating thread. It simply can be screwed on and off coarse thread 40 of hollow extension tip 38. Alternatively, other means may be used for securely fastening ear canal tip 12 to housing 10 to provide for sound transmission therebetween.

Sound Conduit and Support

The "Y" shaped component composed of 32, 32A, and 36, may be made of vinyl, polyethylene, or other acceptable material, as known in the art. In addition to its sound coupling function, it supports and simultaneously provides additional vibration isolation of microphone element 18 and receiver element 22, from each other and from housing 10.

Figure 3:
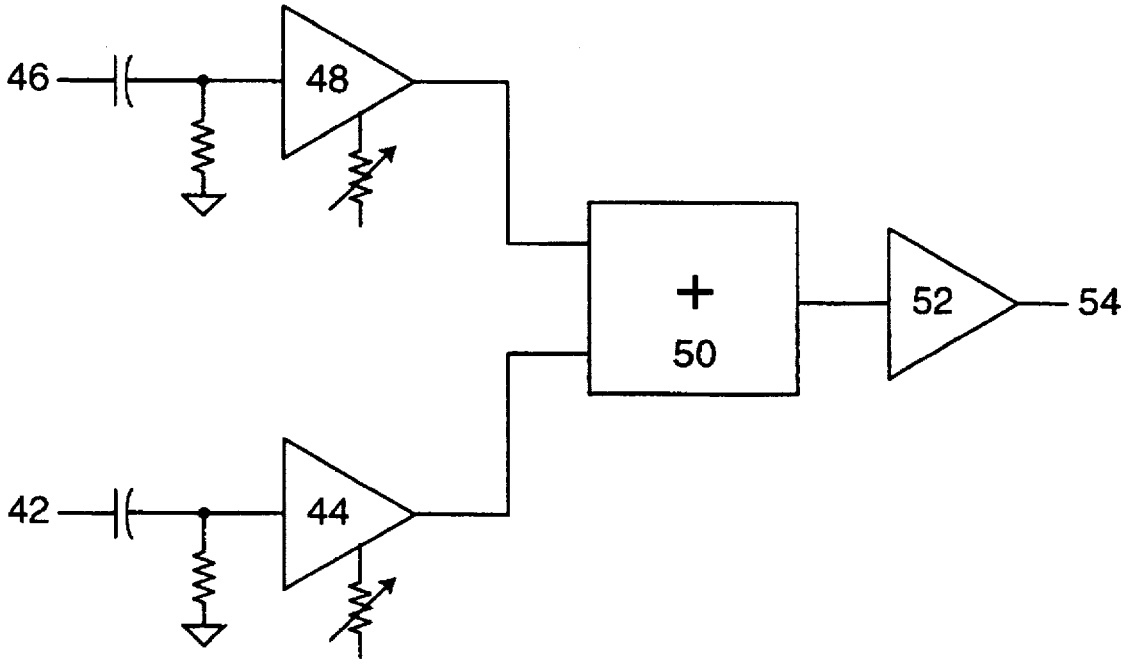
FIG. 3 shows a block diagram of electronic circuitry for a basic two element in-the-ear microphone signal combining and line driving circuit.

FIG. 3 shows a block diagram of a typical signal combining and line driving circuit. As depicted, the output signal from microphone element 18, transmitted via cable 26, is connected to the electronic circuit at high frequency input 42. This signal is routed from input 42 to phase compensating and response adjusting high frequency amplifier module 44. The output signal from vibration-sensing element 20, transmitted via cable 26, is connected to the electronic circuit at low frequency input 46. This signal is routed to phase compensating and response adjusting low frequency amplifier module 48. The outputs from high frequency amplifier module 44 and low frequency amplifier module 48 are combined in summing amplifier 50. The resulting output from summing amplifier 50 is directed to a buffer and line driving amplifier 52. The output signal 54, from buffer and line driving amplifier 52, is a composite signal containing all detected voice energy in the range from 300 Hertz to 3,000 Hertz. Incoming audio signals are transmitted via a buffer amplifier, of common design, and cable 26, to the optional receiver element 22.

In any embodiment of this invention, hollow interior 16 may be filled with sound dampening foam, low density silicone, or other sound dampening material, or combination of materials, as known to those versed in the art. Any of the enumerated embodiments, or others, may be constructed with the electronic circuit suitably mounted within housing 10.

PREFERRED EMBODIMENT—OPERATION

The two active element in-the-ear microphone system functions effectively as follows:

Speech sounds are conducted by the bone, soft tissues and airspaces of the head (not shown) to the walls and tissues of the ear canal (not shown). Ear canal tip 12 couples speech sounds from the ear canal to the two specialized sensors, microphone element 18 and vibration-sensing element 20, contained within the earplug housing 10.

When removable ear canal tip 12 is inserted into an external ear canal, its outer diameter is compressed as it conforms to the shape of the canal. The resultant ear canal tip 12 coupling between the walls of the ear canal and hollow extension tip 38, is sufficient to transfer bone-conducted low frequency speech sounds, via housing 10, to directly stimulate the vibration-sensing element 20, without causing user discomfort. Vibration-sensing element 20, converts the vibrations into an electrical signal. For users with significantly smaller, or significantly larger than average diameter ear canals, other diameter visco-elastic foam inserts are commonly available. Optional flanged ear canal tip 14 may be preferred by some users. The selected tip is slipped onto hollow extension tip 38, or threaded on if coarse thread 40 is present. While acting to couple vibrations to extension tip 38, the compressed ear canal tip 12 also acts as a mechanical low-order low pass filter.

High frequency speech sounds, within the airspace of the ear canal, enter the open core of ear canal tip 12, travel via hollow extension tip 38, sound mixing tube 36, and sound tube 32, to sound receiving port 30 of the high frequency microphone element 18, wherein the high frequency sound is preferentially converted into an electrical signal.

The electrical signals from transducers 18 and 20 travel via electrical and signal leads 24 within cable 26 to an external electronic circuit (typical block diagram shown in FIG. 2) which amplifies and combines the signals from transducers 18 and 20 to provide a single, full speech frequency range, composite output signal 54.

External electrical signals from a computer, special aid, communication device, etc., travel via electrical and signal leads 24 within cable 26, to receiver element 22, wherein electrical signals are converted to sound. The sound exits the receiver via sound transmitting port 34 whence it is conducted via sound tube 32A, sound mixing tube 36, hollow interior 16, and ear canal tip 12 to the air of the ear canal and thence to the tympanic membrane of the ear.

Vibration-sensing element 20 is not responsive to air conducted sounds. Therefore, it acts to discriminate against ambient background noises. Ear canal tip 12, or optional flanged ear canal tip 14, acts as an earplug. Either canal tip is designed to prevent ambient background noise from entering the ear canal and being picked up by microphone element 18. A second earplug assembly, containing only a receiver element, may be assembled to the described system to provide hearing protection to the second ear. If the user must be exposed to an exceedingly high noise environment, circumaural noise attenuating ear-muffs may be worn over the herein described in-the-ear microphone system. This will provide added hearing protection, as well as increased discrimination against ambient noise.

The electronic circuit shown in FIG. 3, may be optionally integrated into the hollow interior of housing 10,

OTHER EMBODIMENTS

Alternative Internal Transducer Mounting—Description

Figure 4:
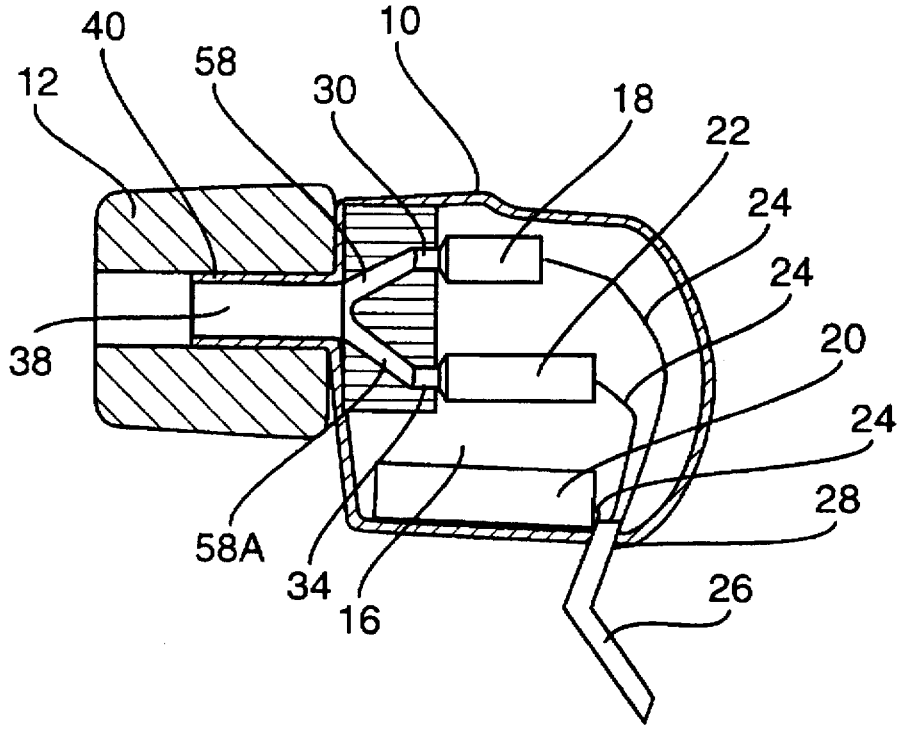
FIG. 4 shows a cross-section elevation view of a similar two element in-the-ear microphone system, with a resilient sound transmission structure retaining microphone and receiver elements.

The two element in-the-ear microphone system of FIG. 2, with an alternative internal transducer mounting, is shown in FIG. 4. A cross-section elevation view of the housing is presented.

In the embodiment shown in FIG. 4, the assembly comprising sound mixing tube 36 and sound tubes 32 and 32A is replaced by rigid sound mixing chamber 56, which accepts and retains sound receiving port 30 and sound transmitting port 34. The internal sound channels 58 and 58A of rigid sound mixing chamber 56 converge to a single opening centered over the proximal opening of hollow extension tip 38. Rigid sound mixing chamber 56 may be adhered to the housing 10 by an appropriate cement or glue, or it may be molded in place, as known in the art.

Alternative Internal Transducer Mounting—Operation

The additional embodiment of the in-the-ear two element microphone system, shown in FIG. 4, functions in a manner identical to that of the preferred embodiment. The only difference is in the replacement of the sound mixing assembly 32-32A-36 with rigid sound mixing chamber 56. In this embodiment, the sound ports of microphone element 18 and receiver element 22 are inserted directly into the openings of sound channels 58 and 58A. High frequency speech sounds, present within the ear canal, are coupled via the open central cores of ear canal tip 12, hollow extension tip 38 and sound channel 58, of rigid sound mixing chamber 56, to sound receiving port 30 of microphone element 18. Low frequency bone-conducted speech vibrations are conducted from ear canal tip 12, hollow extension tip 38 and housing 10 to vibration-sensing element 20, as described in the preferred embodiment operational description and shown in FIG. 2.

Sounds generated by receiver element 22 travel via sound channel 58A of rigid sound mixing chamber 56, and the open cores of hollow extension tip 38 and ear canal tip 12, to the airspace between tip 12 and the tympanic membrane. The sound then stimulates the tympanic membrane.

Microphone System of FIG. 2 Without Receiver—Description

Figure 5:
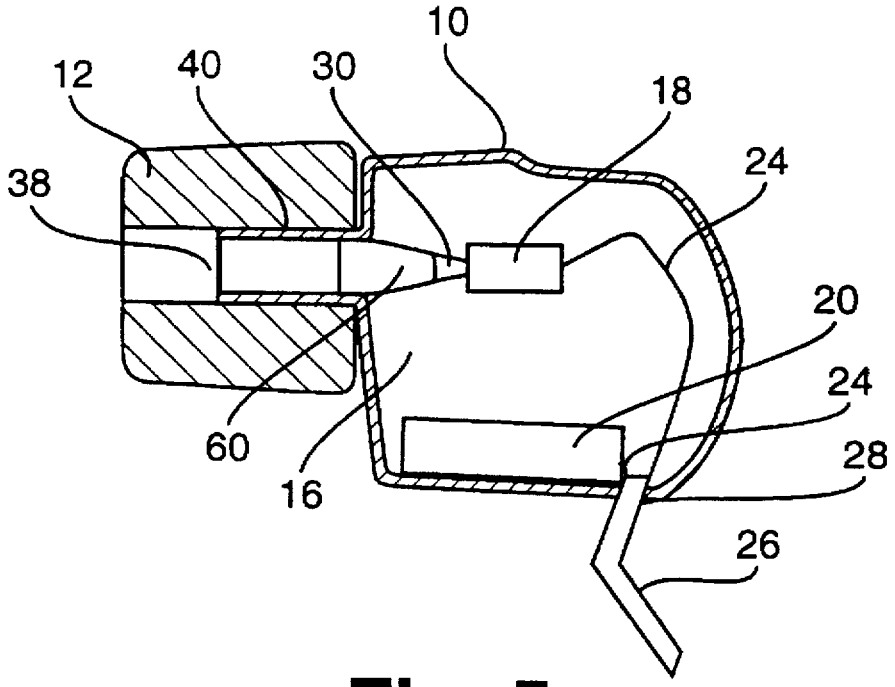
FIG. 5 shows a cross-section elevation view of a similar two element in-the-ear microphone system, without an internal receiver.

An additional embodiment of the invention is shown in FIG. 5. A cross-section elevation view of the housing and contents is presented.

The embodiment shown in FIG. 5, is identical in all aspects to the embodiment of FIG. 2, except that it is constructed without receiver element 22. Microphone element 18 is coupled directly to hollow extension tip 38 via coupler 60.

Microphone System of FIG. 2 Without Receiver—Operation

The additional embodiment of the two element in-the-ear microphone system shown in FIG. 5, functions in a manner identical to that of the preferred embodiment shown FIG. 2, except that no receiver element is used. Sound mixing assembly 32-32A-36, of the preferred embodiment is replaced by coupler 60, as shown in FIG. 5. High frequency speech sounds present within the ear canal are coupled via the open central cores in ear canal tip 12, hollow extension tip 38 and coupler 60, to sound receiving port 30 of microphone element 18. Low frequency bone-conducted speech vibrations are conducted from ear canal tip 12, hollow extension tip 38 and housing 10 to vibration-sensing element 20, as described in the preferred embodiment operational description.

CONCLUSIONS, RAMIFICATIONS, AND SCOPE

Accordingly, it can be seen that, according to the invention, I have provided a new two active element in-the-ear microphone system which provides a composite wide speech frequency range voice signal to external devices and which discriminates against ambient background noise while providing measurable hearing protection to the user's ear.

Thereby in-the-ear microphones which provide only a single mode of transduction have been replaced with a new two complimentry transducer system. This system can sense lower amplitude higher frequency consonant and fricative sounds, combine them with lower frequency speech sounds picked up via a bone-conduction vibration sensor, and thus provide a fuller speech spectrum composite signal to external devices and systems.

Although the description above contains many specificities, these should not be construed as limiting the scope of the invention but as merely providing illustrations of some of the presently preferred embodiments of this invention. Various other embodiments and ramifications are possible within it's scope. For example, the two element in-the-ear microphone system may be constructed with the electronic circuitry (not shown) installed within the housing 10. Further, a battery to power the electronic circuitry and the transducers may be included within the housing. Also, for certain applications, one or more miniature parameter adjustment controls may be integrated into the structure of the housing.

Thus the scope of the invention should be determined by the appended claims and their legal equivalents, rather than by the examples given.

What is claimed is:

1. An in-the-ear bone and airborne audio pickup system for use in conjunction with systems requiring speech sound input, comprising:

a housing adapted for positioning at the ear canal of the user, said housing having a plurality of audio transmission paths for separately receiving low speech frequency voice-range audio signals and high speech frequency voice-range audio signals generated by the user's voice;

a first sound transducer means coupled to one of said plurality of audio transmission paths and adapted to be responsive to nonairborne sound;

a second sound transducer means coupled to another of said plurality of audio transmission paths and adapted to be responsive to airborne sound;

electronic circuit means coupled to each of said first and second sound transducer means for enhancing the quality of voice audio information received by said first and second sound transducer means;

means for combining outputs of said electronic circuit means into a single electrical signal; and means for coupling said electrical signal to an external device or system.

2. The system of claim 1 further comprising a receiver mounted in said housing for optionally coupling to said external device or system and having an audio output means coupled to one of said audio transmission paths.

3. The system of claim 1, wherein said housing includes an ear canal tip constructed and adapted for insertion into the ear canal of the user, said plurality of transmission paths extending through said ear canal tip.

4. The system of claim 3, wherein said first audio transmission path comprises the body of said housing and said second path comprises a hollow core extending through said ear canal tip.

5. The system of claim 4, wherein said first sound transducer means is a vibration sensing element and said second sound transducer means is an electret microphone element.

6. The system of claim 4, further comprising a receiver element mounted in said housing for coupling to said external device or system and having an audio output means coupled to said second audio path.

7. A speech pickup system for use in a system requiring voice input for operation, control, information submission, or communication comprising:

a housing having a hollow extension tip with an ear canal tip mounted thereon for insertion into the ear canal of a user;

first sound sensing and transducing means and second sound sensing and transducing means mounted within said housing, said first sound sensing and transducing means being responsive to nonairborne sound, and said second sound sensing and transducing means being responsive to airborne sound;

first sound transmission means and second sound transmission means in said housing, hollow extension tip and ear canal tip, coupling said first and second sound sensing and transducing means respectively to the user, for reception of the user's speech thereby;

electronic circuitry to normalize a first and second transducer speech signals and thence combine them into a single composite signal; and means for coupling the output of said circuitry to an external device or system.

8. The system of claim 7 wherein said first and second sound sensing and transducing means are specialized to receive different parts of the speech frequency spectrum.

9. The system of claim 8 wherein said first sensing and transducing means receives lower speech frequencies than said second sensing and transducing means and said second sensing means is predisposed to sense mostly higher speech frequency sounds.

10. The system of claim 9 wherein the ear canal tip, hollow extension tip, and housing comprise the sound path for said first sensing and transducing means.

11. The system of claim 10 wherein said first sensing and transducing means is predisposed to reject airborne sounds.

12. The system of claim 11 wherein said ear canal tip is predisposed to prevent ambient background noise from entering the ear canal.

13. Apparatus for detecting user speech for use in a system requiring voice input, said apparatus being adapted for placement in the ear of a user during operation, said apparatus comprising:

a housing having a dense outer surface for transmitting vibration therethrough, and a hollow ear canal tip mounted thereon for insertion into the ear canal of a user;

a first sound sensing and transducing means mounted within said housing in operating contact with said housing surface and adapted to detect speech generated sound vibration present in said surface, said first sound sensing and transducing means being adapted to generate first electrical signals responsive to detected speech generated sound vibration; and, a second sound sensing and transducing means being adapted to generate second electrical signals responsive to airborne sound located in said ear canal.

14. Apparatus as defined in claim 13 further including electronic circuitry operably connected to said first sound sensing and transducing means and second sound sensing and transducing means for normalizing said first and second electrical signals and combining them into a single output signal, and means for coupling the output of said circuitry to an external device or system.

* * * * *